US006398703B1

(12) United States Patent
Keller

(10) Patent No.: US 6,398,703 B1
(45) Date of Patent: Jun. 4, 2002

(54) FACILITY AND MACHINE FOR PRODUCING PADDED-LIKE PACKING MATERIAL

(76) Inventor: Reinhard Keller, Rebhalde 10, CH-8421 Dättlikon (CH)

( * ) Notice: Subject to any disclaimer, the term of this patent is extended or adjusted under 35 U.S.C. 154(b) by 0 days.

(21) Appl. No.: 09/600,365

(22) PCT Filed: Jan. 7, 1999

(86) PCT No.: PCT/CH99/00007

§ 371 (c)(1),
(2), (4) Date: Sep. 5, 2000

(87) PCT Pub. No.: WO99/36252

PCT Pub. Date: Jul. 22, 1999

(30) Foreign Application Priority Data

Jan. 17, 1998 (CH) ..... 99/98
Oct. 14, 1998 (CH) ..... 2069/98

(51) Int. Cl.[7] ..... B31F 7/00

(52) U.S. Cl. ..... 493/350; 493/967; 493/185; 493/352

(58) Field of Search ..... 493/967, 185, 493/350, 352, 464

(56) References Cited

U.S. PATENT DOCUMENTS 4,619,635 A 10/1986 Ottariano
4,650,456 A 3/1987 Armington
4,750,896 A 6/1988 Komaransky
4,968,291 A * 11/1990 Baldacci et al. ..... 493/464
5,840,004 A * 11/1998 Ratzel ..... 493/352
5,897,481 A * 4/1999 Baumuller ..... 493/464

FOREIGN PATENT DOCUMENTS

WO 9714553 4/1997
WO 9727136 7/1997

* cited by examiner

*Primary Examiner*—Rinaldi I. Rada
*Assistant Examiner*—Sameh Tawfik
(74) *Attorney, Agent, or Firm*—Sidley Austin Brown & Wood, LLP

(57) ABSTRACT

An apparatus for manufacturing a cushioning packaging material from a web-shaped material having at least two layers, the apparatus comprising a material supply shaft for deforming side edges of the web-shaped material into a substantially rolled shape with bead-shaped margins, and a device for receiving a deformed material and for joining layers of the deformed material and having a first wheel-shaped member and a second wheel-shaped member the axes of the rotation of which lie in a plane inclined to a running plane of the deformed material, which is determined by a longitudinal extent of the supply shaft, at an angle deviating from a right angle.

19 Claims, 6 Drawing Sheets

FACILITY AND MACHINE FOR PRODUCING PADDED-LIKE PACKING MATERIAL

BACKGROUND OF THE INVENTION

1. Field of the Invention

The present invention relates to an apparatus for the manufacture of a cushion-like packaging material from a web-like supply material having at least two layers and including a supply shaft which causes the edges of the supply material to be deformed into a substantially rolled shape, such that the margins are formed in bead-like manner, and a device for receiving the deformed supply material and for joining the latter along the substantially central region in the longitudinal extent of the supply material, wherein the device has at least one first and one second wheel-shaped members, with embossing sections formed at the periphery of the latter, which are in engagement in order to join the oppositely disposed edge regions of the supply material by embossing when the rolled regions pass between the embossing elements.

2. Description of the Prior Art

The apparatuses which are used for the manufacture of cushion-like packaging material from a web-like supply material having at least two layers consist essentially of a supply shaft which deforms the side edges of the supply material into a substantially rolled shape, and of a device for joining the deformed supply material in the central region in its longitudinal extent by embossing. For this purpose gear teeth or chain wheels which are pressed towards each other are provided with embossing sections which mesh with one another and form the joining region. The deformed supply material runs through this region. It is to be assumed that the layers have non-uniform contact in the central region of the deformed supply material, and that the depth of the embossed features is dependent on the pre-stress of the gearwheels, so that the layers are arbitrarily embossed or perforated. From this it follows that exposed connection locations of different quality are produced, which is a disadvantage.

Furthermore, apparatuses are used which join the paper layers by means of perforation. Such apparatuses have the disadvantage that considerable quantities of paper dust are produced by the perforation, which significantly impair the working conditions for the personnel and result in a greater amount of work and cost through the required cleaning.

Such devices are a component of machines for manufacturing cushion-like packaging material which is produced as a continuous strand or in predetermined lengths. In order to produce packaging material in predetermined lengths, a cutting device is provided. The machine contains a drive motor for the apparatus and a drive motor for the cutting device which determine the speed of conveyance and the cutting speed respectively. The greater amount of work and cost involved, in particular the fact that the cutting process is carried out with a uniform movement, has proved disadvantageous. The conveyance and the cutting are thus controlled separately such that the conveying is interrupted and cutting subsequently takes place. In this way the movable knife is moved forwards and backwards. This interruption persistently restricts the production performance of the machine.

SUMMARY OF THE INVENTION

This and other objects of the present invention, which will become apparent hereinafter, are achieved by providing an apparatus in which the axes of rotation of the first and second members are arranged lying in a plane which is inclined, with respect to the running plane of the deformed supply material predetermined by the supply shaft, by an angle that deviates from a right angle; and by providing a machine for the manufacturer of a cushing-line packing material including such an apparatus.

This object is satisfied in accordance with the invention by the features of claim 1.

The advantages which can be achieved by the invention are to be seen in the fact that the inclined arrangement of the first and second members improves the drawing-in of the paper web, and the apparatus is operated with a higher speed of rotation.

By means of the support elements or support discs an invariable connection of the layers in a defined region is achieved in advantageous manner.

A machine with an apparatus is characterized by the features of claim 6.

This machine has the advantages that only one drive is provided and that the production of packaging material at a higher speed of rotation and with a continuous conveyance is ensured by means of acceleration of the cutting movement.

BRIEF DESCRIPTION OF THE DRAWINGS

The invention will be now explained in detail with reference to the accompanying drawings.

There are shown.

DETAILED DESCRIPTION OF THE PREFERRED EMBODIMENT

The inventive apparatus forms part of a machine for the manufacture of a cushion-like packaging material and which further includes a cutting apparatus and a drive apparatus for displacing respective material webs.

Figure 1:
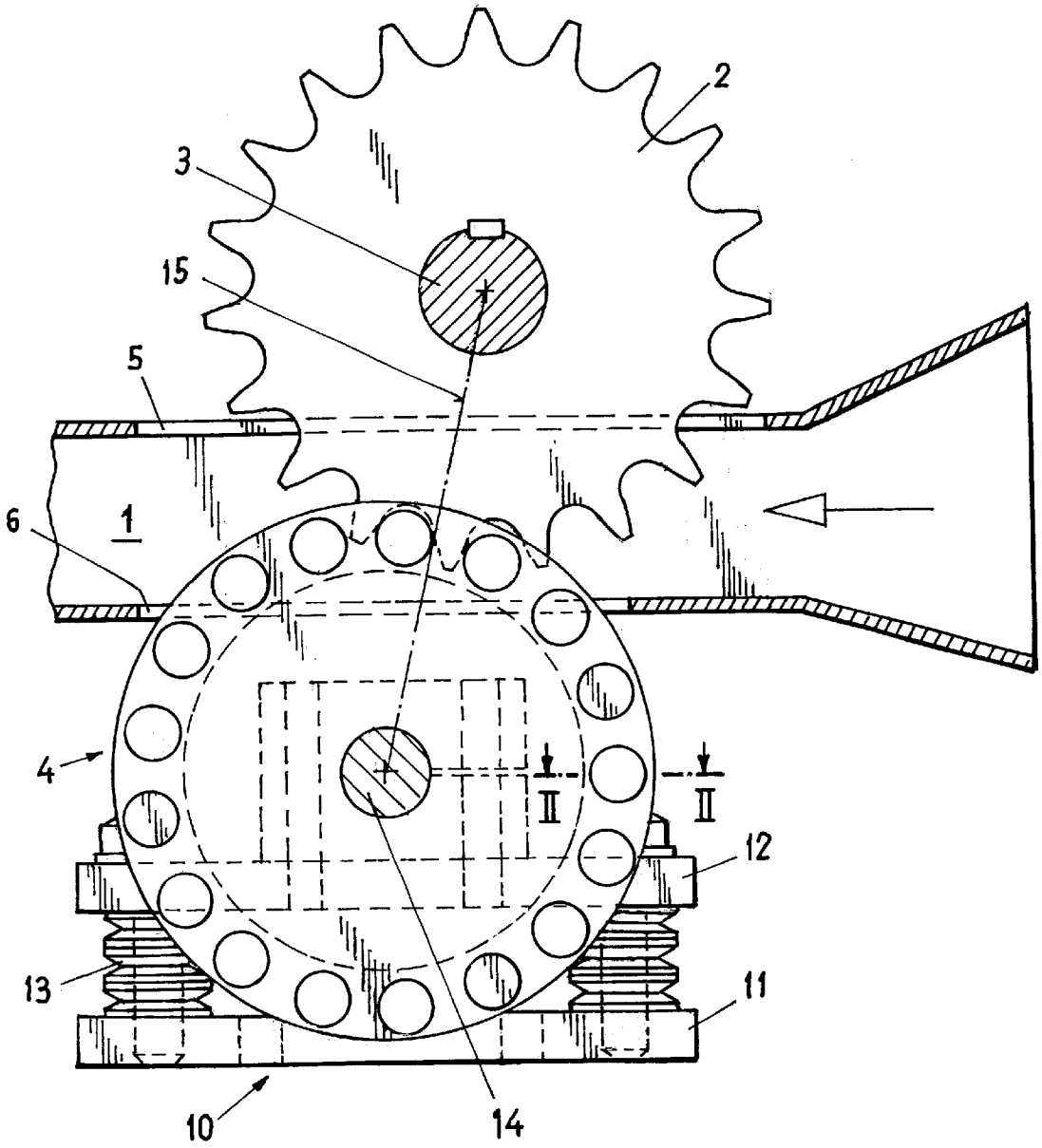
FIG. 1 a first embodiment of an apparatus in accordance with the invention.
Figure 2:
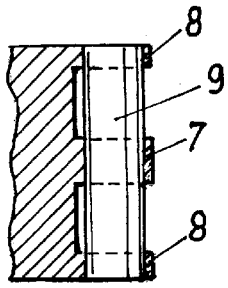
FIG. 2 a section along the line II—II in FIG. 1.

Reference is made to FIGS. 1 and 2. The apparatus contains a shaft 1 for the supply of the paper layers to be joined, two chain wheels 2 having a predetermined tooth pitch which are secured behind one another on a drive axle 3, and a counter-wheel 4. The shaft 1 has a rectangular cross-section and a respective cut-out 5, 6 in each of the broad sides. As FIG. 2 shows, the counter-wheel 4 is provided with a plurality of pins 9, which are arranged with a pitch corresponding to the tooth pitch of the chain wheels 2. At the periphery of the counter-wheel 4, a first ring-like projection 7 is formed in the central region, and two respective projections 8 are formed in the edge regions. The pins 9 are arranged in the projections 7 and 8, with the diameter of the circumscribing circle of the pins being smaller than the diameter of the circumference of the projections 7 and 8, so that the projections form support elements for the paper layers. The counter-wheel 4 is freely rotatable on an axle 14 of a bearing units 10. The bearing unit 10 contains a base plate 11 of fixed position, a movable holding plate 12 which is supported on the base plate via plate springs 13 and two bearing blocks for the counter-wheel 4, which are secured on the holding plate 12.

The association of the chain wheels 2 and of the counter-wheel 4 relative to one another and relative to the supply shaft 1 can be seen from FIG. 1. Turning away from the known apparatuses, the plane 15 of the apparatus under discussion here, which extends through the axes of rotation of the chain wheels and of the counter-wheel, is arranged so that it is inclined to the running plane of the deformed supply material, which is determined by the supply shaft 1, at angle that deviates from a right angle. In this way a better connection of the layers to one another is, on the one hand and, on the other hand the through-movement of the layers and in particular the runout of the packaging material is improved in advantageous manner. Furthermore, as a result of this association, the layers are first engaged by the chain teeth and pressed against the jacket surface of the support elements 7 and 8 of the counter-wheel 4, whereby the joining region of the layers is determined. In the actual joining region, i.e. in the sections between the support elements 7 and 8, the connection takes place by pressing of the layers.

Figure 3:
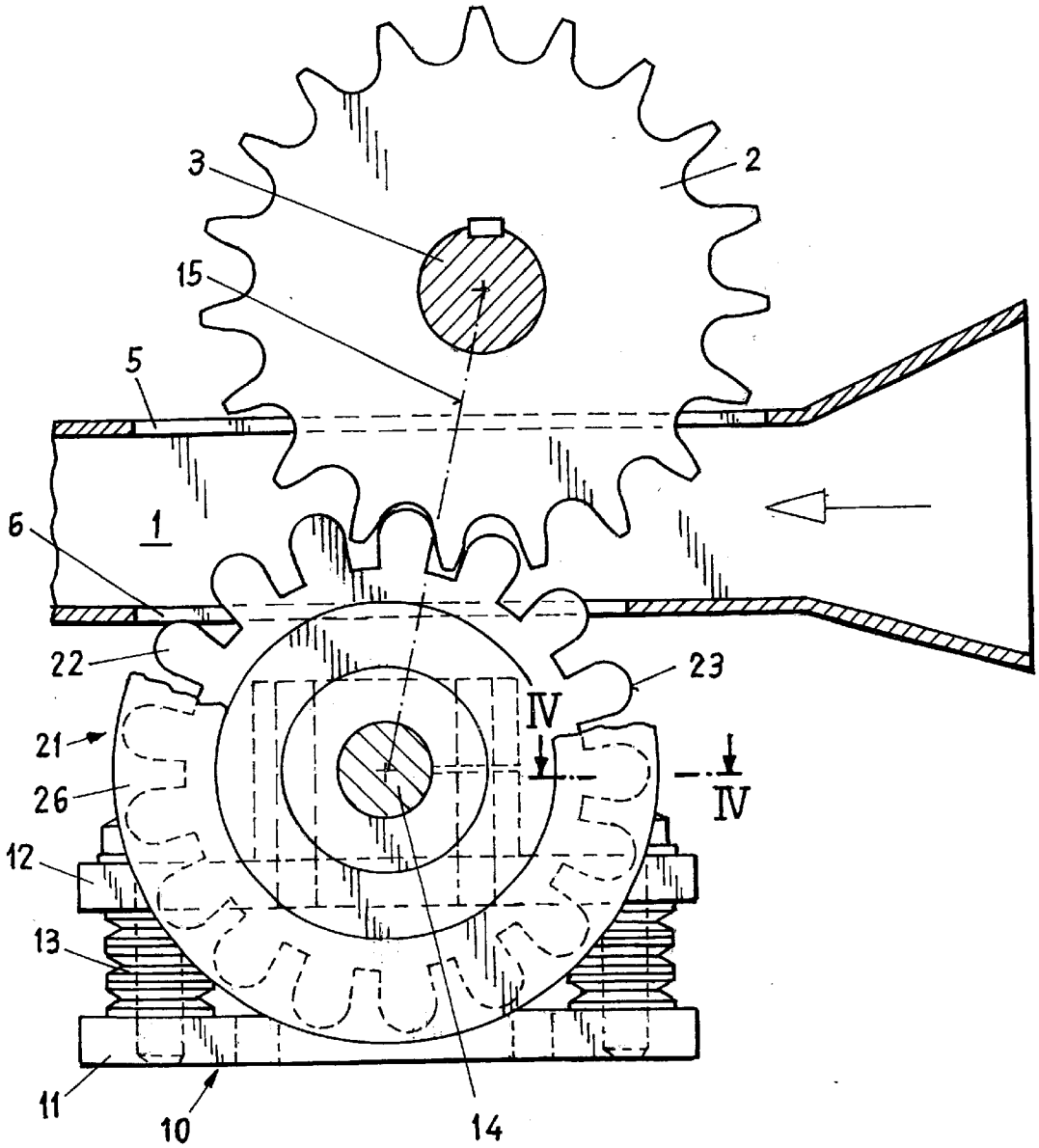
FIG. 3 a second embodiment of an apparatus in accordance with the invention.
Figure 4:
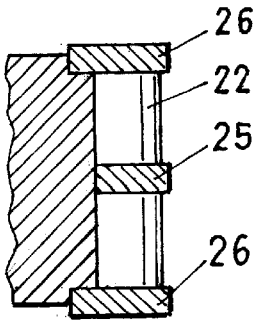
FIG. 4 a section along the line V—V in FIG. 3.

The apparatus shown in FIGS. 3 and 4 is distinguished from the above described apparatus only by the counter-wheel 21, so that the following description will simply be restricted to the design of the latter. The counter-wheel 21 has two rows of teeth at the periphery, which are arranged in parallel. Each row of teeth has a plurality of teeth 22, which mesh with the chain wheels 2. The teeth have a round apex section 23 and tooth flanks which converge towards the tooth root. Instead of the projections in the counter-wheel 4 in accordance with FIGS. 1 and 2, disc-like rings 26 and 25 are arranged as support elements between the tooth rows and at the end faces of the counter-wheel and secured by suitable means.

Figure 5:
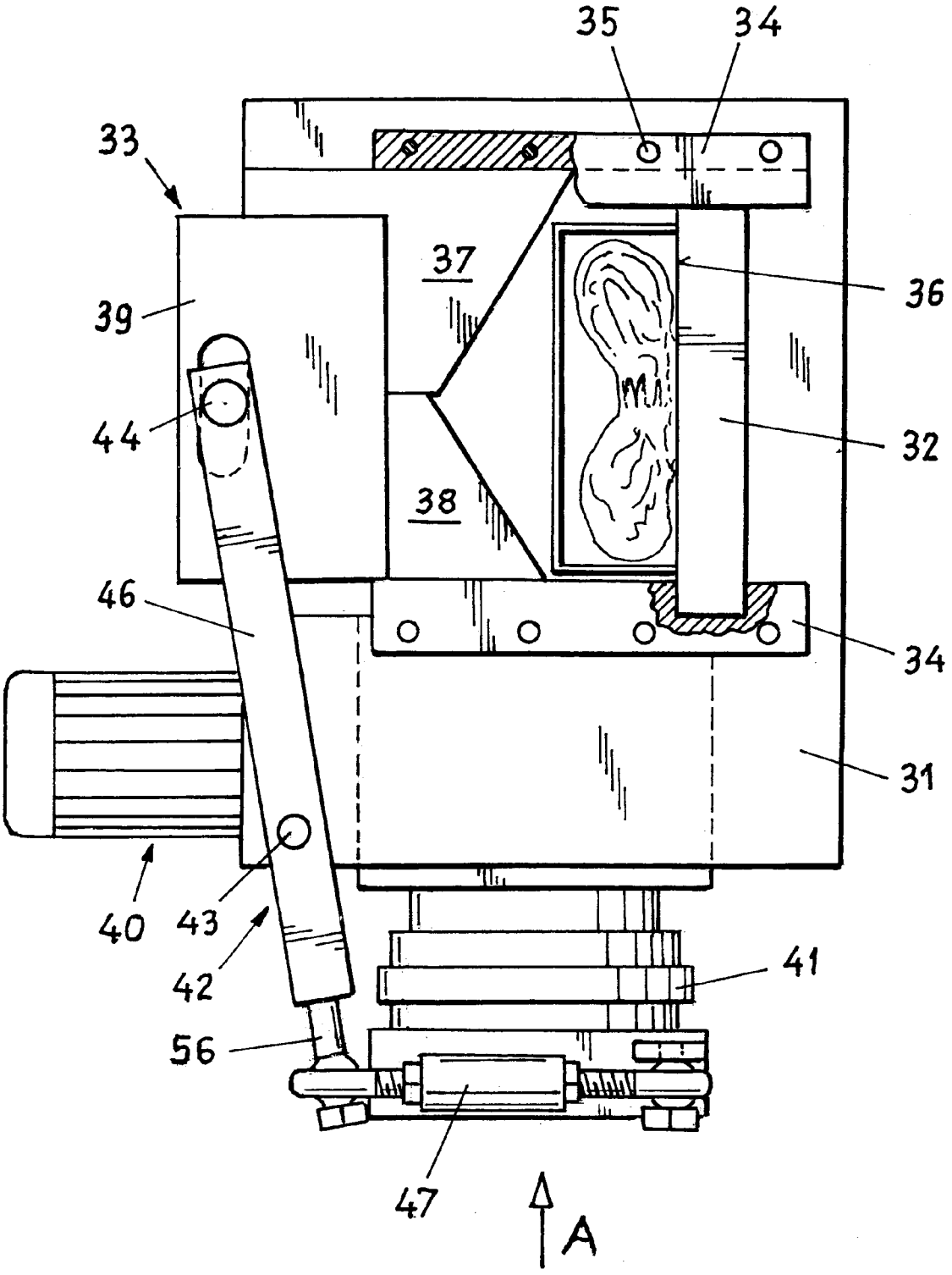
FIG. 5 a view of the cutting apparatus.
Figure 6:
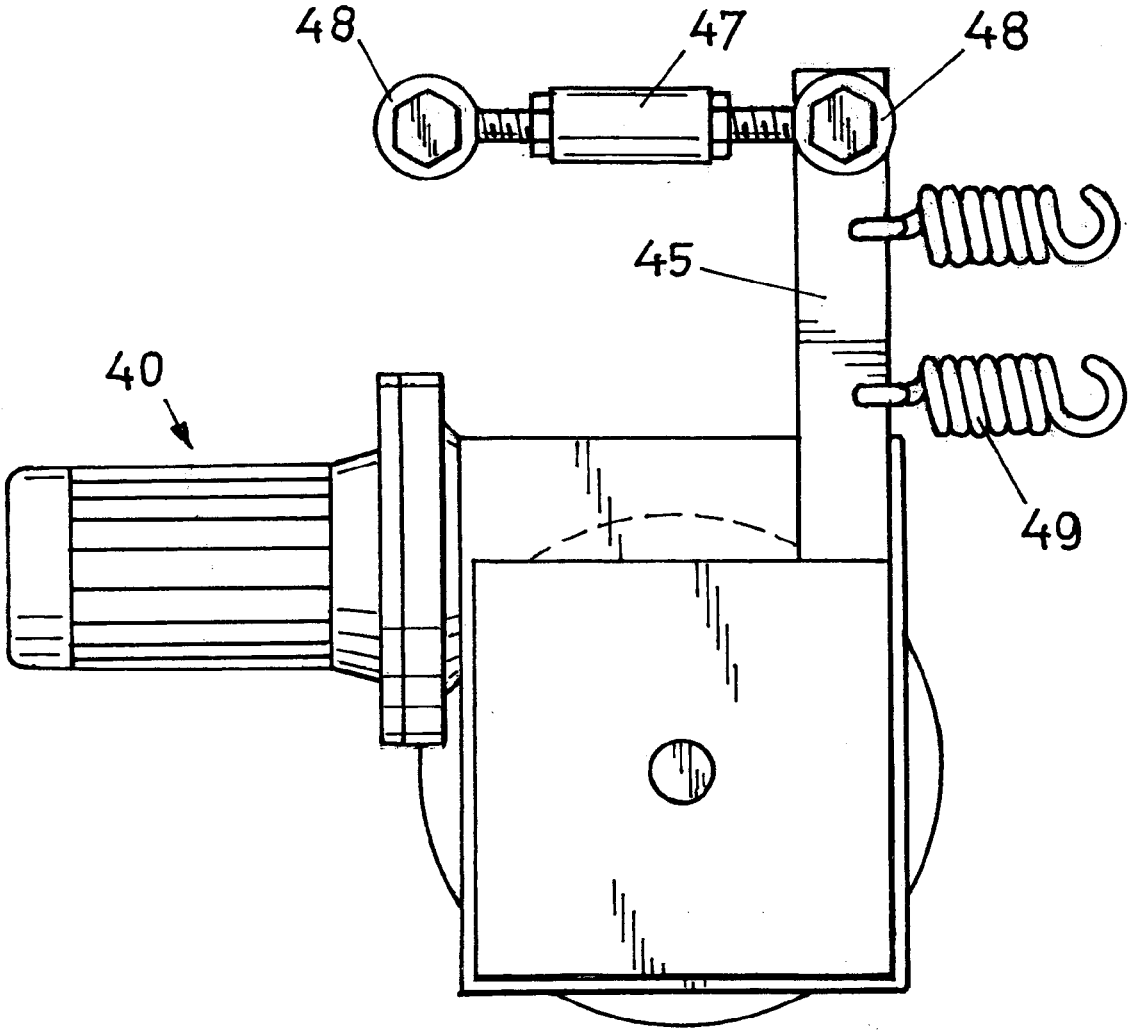
FIG. 6 a view in the direction of the arrow A in FIG. 5.

Reference is made to FIGS. 5 and 6. As FIG. 5 shows, the cutting apparatus is so connected to the supply shaft 1 of the apparatus by means of a plate 31 that the supply shaft is flush with the upper side of the plate. The cutting apparatus contains a stationary knife 32 and a movable knife 33. Guide strips 34 for the movable knife 33 are secured by suitable means to the plate 31. The stationary knife 32 is so secured to the guide strips 34 that the cutting edge 36 is flush with the edge which bounds the opening of the supply shaft. The movable knife 33 consists of two part knives 37, 38 and a connection plate 39, on which the part knives are secured and which has an elongate hole in order to connect the movable knife to a later described lever arrangement. The part knives 37, 38 have inclined cutting edges and are so secured to the connection plate 39 that, on the one hand, their cutting edges are displaced relative to one another and jointly form a diverging knife edge with respect to the opening of the supply shaft. With this arrangement the cutting of the packaging material is improved in advantageous manner.

As initially mentioned, the cutting apparatus is connected to the drive apparatus 40. For this purpose a clutch 41 and a lever arrangement 42 are provided. The clutch is a customary magnetic clutch, with which the connection of the lever arrangement to the common drive shaft takes place. The lever arrangement 42 comprises a one-armed lever 45, which is connected to the movable clutch part, a two-armed lever 46, which is connected to the movable knife 31, and a connecting rod 47 with two articulated joint heads 48, which are connected to the one-armed lever and to the two-armed lever respectively. Two tension springs 49 are provided which are hung onto the one-armed lever at one end and onto the non-illustrated frame at the other end in order to keep the first lever in a rest position. The two-armed lever 46 is journalled on a pin 50, which is arranged on the plate 31. The two-armed lever 46 is connected by means of a screw 51 to the connecting rod 47, and via a pin 52, which engages into the elongate hole of the connection plate 39, to the movable knife 33.

The lever arrangement 42 is intended to convert the rotary movement of the drive shaft into a translatory knife movement and to accelerate the knife movements such that the packaging material supplied with an advance of over 30 meters per minute of the cutting apparatus is reliably cut without interrupting the supply.

Figure 7:
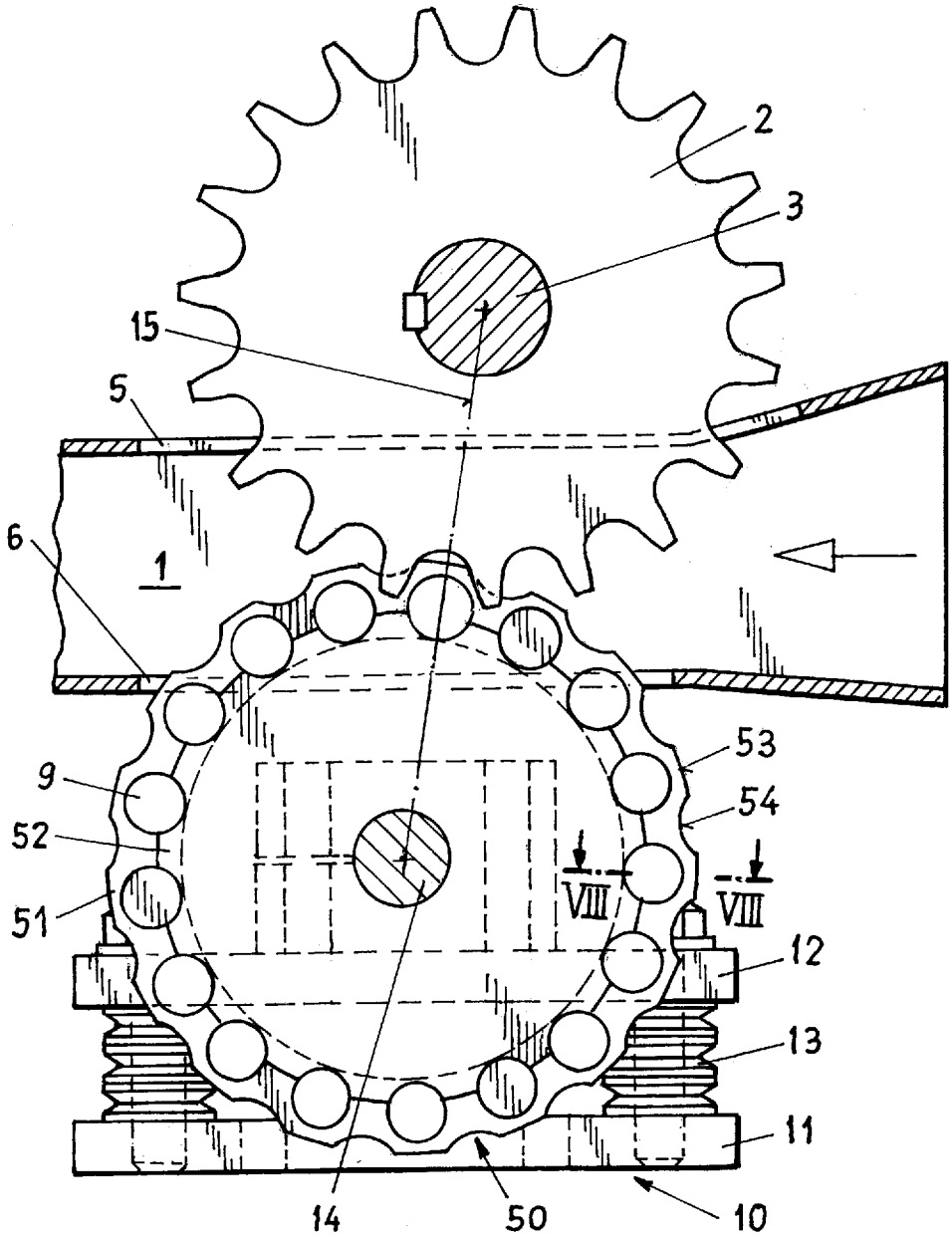
FIG. 7 a preferred embodiment of an apparatus in accordance with the invention.
Figure 8:
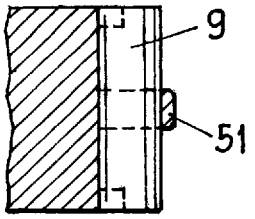
FIG. 8 a section along the line II—II in FIG. 7.

Reference is made to FIGS. 7 and 8. The apparatus contains a shaft 1 for the supply of the paper layers to be joined, two chain wheels 2 with a predetermined tooth pitch which are secured alongside one another on a drive axle 3, and a counter-wheel 4. The shaft 1 has a rectangular cross-section and a respective cutout 5, 6 in each of the broad sides. As FIG. 2 shows, the counter-wheel 50 is provided with a plurality of pins 9, the pitch of which corresponds to the tooth pitch of the chain wheels 2. At the periphery of the counter-wheel 50, a first ring-like projection 51 is formed in the central region, and respective second ring-like projections 52 are formed in the edge regions. The first projection 51 contains sections with holes for the attachment of the pins 9, and the second projections contain sections with trough-like cutouts for the reception of the pins 9.

The first projection 51 has a contour with projecting sections 53 and set back sections 54. The projecting sections 54 lie on a circumscribed circle, the diameter of which is at least 1 mm greater than the circumscribed circle of the pins. The set back sections 54 are of trough-like shape, with their apexes lying on the circumscribed circle of the pins 9. The edges of the sections, in particular of the projecting sections, are rounded. This has the advantage that a cutting of the through-running paper layers is avoided. As a consequence, less paper dust is produced. The counter-wheel 50 is freely rotatably journalled in two bearing units 10, of which only one bearing unit is shown. Each bearing unit 10 contains a stationary base plate 11 and a movable holding plate 12, which is supported via plate springs 13 on the base plate. A pedestal bearing for the counter-wheel 4 is secured to the holding plate 12.

Figure 9:
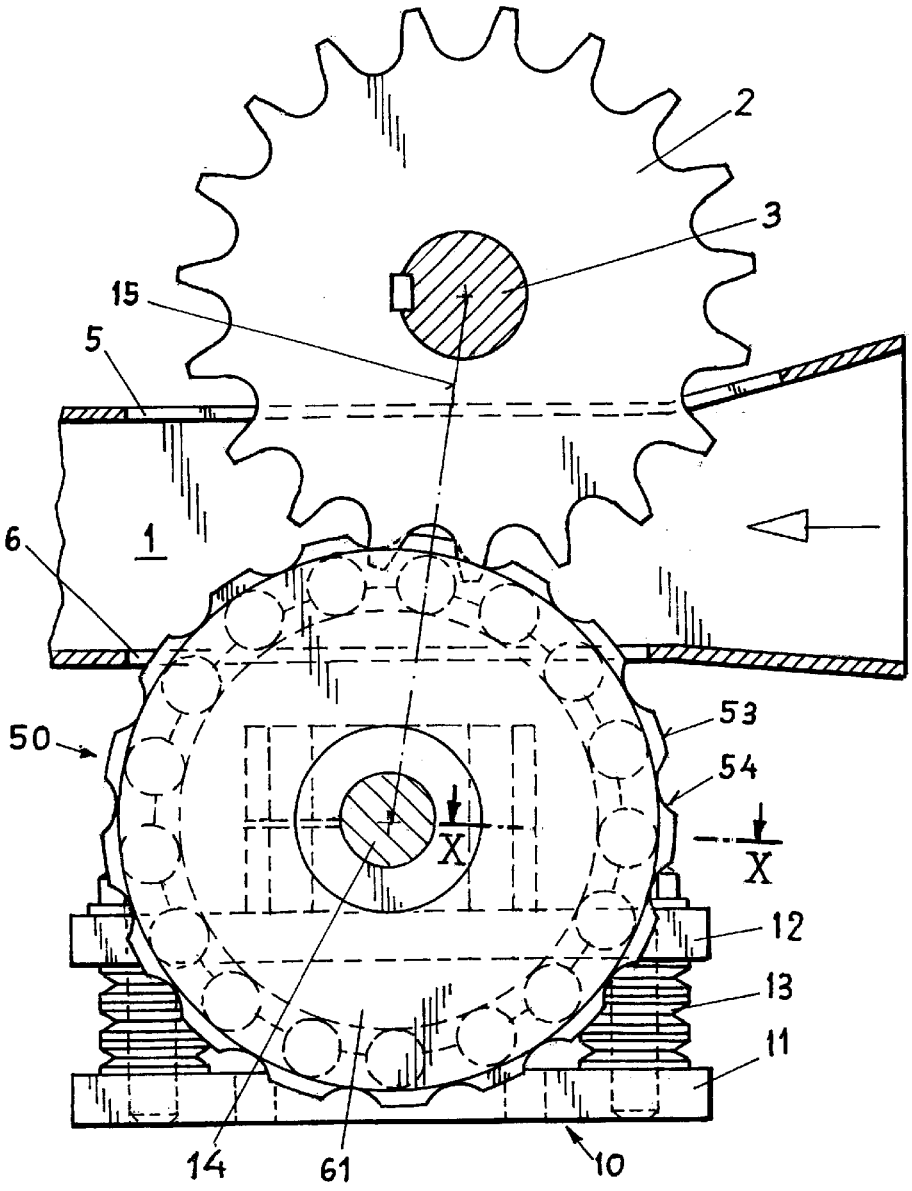
FIG. 9 a third embodiment of an apparatus in accordance with the invention.
Figure 10:
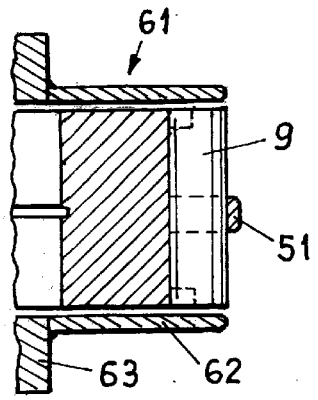
FIG. 10 a section along the line IV—IV in FIG. 9.

The embodiment of the apparatus shown in FIGS. 9 and 10 is distinguished from the embodiment of FIGS. 7 and 8 in that a respective support disc 61 is arranged at each of two sides of the counter-wheel 50, with the support discs determining the joining region. The support discs 61 have a diameter which is the same as the diameter of the circumscribed circle of the pins 9. It is pointed out that in dependence on the type of paper to be deformed, support discs with a greater or smaller diameter can be used in order to prevent bursting of the paper layers during the embossing action. The support discs have a disc 61 and a hub 63 and consist of metal or plastic. The support discs can also be made in one piece. At the periphery, the support discs are rounded. The support discs are rotatably or fixedly mounted on the axle of the counter-wheel.

As FIGS. 7 and 9 show, the association of the chain wheels 2 and of the counter-wheel 50 is the same as in the embodiments of FIGS. 1 to 4.

Furthermore, a control apparatus (not shown) is provided which consists of known electrical and electronic components and has a control panel and is intended to ensure a continuous manufacture of the packaging material, a manual triggering of the cutting process and the automatic production of packaging material of predetermined length. A keyboard is provided in the control panel for the determination of the length.

What is claimed is:

1. An apparatus for manufacturing a cushioning packaging material from a web-shaped material having at least two layers, the apparatus comprising a material supply shaft for deforming side edges of the web-shaped material into a substantially rolled shape with bead-shaped margins; and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft, and wherein the first wheel shaped member is formed as a chain wheel, and the second wheel-shaped member is provided with a plurality of pins on the periphery thereof, the plurality of teeth of the first wheel-shaped member and the plurality of pins of the second wheel-shaped member forming the embossing sections of the first and second wheel-shaped members, respectively.

2. An apparatus for manufacturing a cushioning packaging material from a web-shaped material having at least two layers, the apparatus comprising a material supply shaft for deforming side edges of the web-shaped material into a substantially rolled shape with bead-shaped margins; and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft, and wherein the apparatus further comprises at least one support element provided in a central region of the second wheel-shaped member and having an outer diameter which is larger than a circumscribed circle of the embossing sections.

3. An apparatus according to claim 2, further comprising two support elements provided at the second wheel-shaped member and having an outer diameter which is larger than a circumscribed circle of the embossing sections.

4. An apparatus according to claim 2, wherein the support elements are formed as one of ring-like projections and ring discs secured to the second wheel-shaped member.

5. An apparatus for manufacturing a cushioning packaging material from a web-shaped material having at least two layers, the apparatus comprising a material supply shaft for deforming side edges of the web-shaped material into a substantially rolled shape with bead-shaped margins; and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft, and wherein the embossing section of one of the first and second wheel-shaped members comprising a plurality of embossing elements separated from each other by one of ring-shaped projections and ring discs.

6. An apparatus for manufacturing a cushioning packaging material from a web-shaped material having at least two layers, the apparatus comprising a material supply shaft for deforming side edges of the web-shaped material into a substantially rolled shape with bead-shaped margins; and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft, and wherein the first wheel-shaped member is formed as a chain wheel, and the second wheel-shaped member has, at the periphery thereof in a central region thereof, a first ring-shaped projection and has, at the periphery thereof at marginal regions, second ring-shaped projections, the second wheel-shaped member further having a plurality of pins arranged on a pitch circle in the first ring-shaped projection, with the pins being secured in the first ring-shaped projection, supported in the second ring-shaped projections and having ends thereof substantially exposed.

7. An apparatus according to claim 6, wherein ring-like projection has projecting and recessed sections.

8. An apparatus according to claim 7, wherein the projecting sections of the first ring-shaped projection are rounded off.

9. An apparatus according to claim 6, further comprising at least two support discs, which are arranged on opposite sides of the second wheel-shaped member in order to determine a joining region at the supply material to be deformed during a joining process.

10. An apparatus according to claim 9, wherein the support discs are arranged spaced from the second wheel-shaped member on an axle of the second wheel-shaped member.

11. An apparatus according to claim 10, wherein support discs have an outer diameter which is one of the same as and different from a diameter of a circumscribed circle of the pins, and the support discs are rounded at the periphery.

12. An apparatus according to claim 10, wherein the support discs are formed of one of metal and plastic.

13. A machine for manufacturing a cushioning packaging material from a web-shaped material having at least two layers, the machine comprising a manufacturing apparatus including a material supply shaft for deforming side edges of the web-shaped material into a substantially rolled shape with bead-shaped margins, and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft;

a cutting apparatus having a fixed cutting member and at least one movable cutting member;

a drive apparatus connected to the manufacturing and cutting apparatuses and having a common drive shaft with the manufacturing and cutting apparatuses; and means for accelerating a cutting movement and coupled to the common drive shaft, the accelerating means including a clutch and a lever arrangement, with the clutch being capable of being brought into and out of engagement with the common drive shaft and being connected to the movable cutting member in order to convert a rotary movement into an accelerated translational movement.

14. A machine for manufacturing a cushioning packaging material from a web-shaped material having at least two layers, the machine comprising a manufacturing apparatus including a material supply shaft for deforming side edges of the web-shaped material into a substantially rolled shape with bead-shaped margins, and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft;

a cutting apparatus having a fixed cutting member and at least one movable cutting member;

a drive apparatus connected to the manufacturing and cutting apparatuses and having a common drive shaft with the manufacturing and cutting apparatuses; and means for accelerating a cutting movement and coupled to the common drive shaft, wherein the cutting apparatus has a plate having a rectangular opening connected to the supply shaft of the manufacturing apparatus, with the supply shaft opening into the rectangular opening, wherein the stationary cutting member is secured to a longitudinal side of the rectangular opening on the plate, and wherein the movable cutting member has a V-shaped blade the cutting edges of which diverges towards the rectangular opening.

15. A machine for manufacturing a cushioning packaging material from a web-shaped material having at least two layers, the machine comprising a manufacturing apparatus including a material supply shaft for deforming side edges of the web-shaped material into a substantially rolled shape with bead-shaped margins, and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft;

a cutting apparatus having a fixed cutting member and at least one movable cutting member;

a drive apparatus connected to the manufacturing and cutting apparatuses and having a common drive shaft with the manufacturing and cutting apparatuses; and means for accelerating a cutting movement and coupled to the common drive shaft, Wherein the movable cutting member is formed of two knives which are arranged aligned in a common plane such that the cutting edges of the knives are displaced relative to one another.

16. A machine for manufacturing a cushioning packaging material from a web-shaped material having at least two layers, the machine comprising a manufacturing apparatus including a material supply shaft for deforming side edges of the web-shaped material into a substantially rolled shape with bead-shaped margins, and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft;

a cutting apparatus having a fixed cutting member and at least one movable cutting member;

a drive apparatus connected to the manufacturing and cutting apparatuses and having a common drive shaft with the manufacturing and cutting apparatuses; and means for accelerating a cutting movement and coupled to the common drive shaft, wherein the drive apparatus is formed as a geared motor, and the clutch is formed as an electrical clutch.

17. A machine for manufacturing a cushioning packaging material from a web-shaped material having at least two layers, the machine comprising a manufacturing apparatus including a material supply shaft for deforming side edges of the web-shaped material into a substantially rolled shape with bead-shaped shaped margins, and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft;

a cutting apparatus having a fixed cutting member and at least one movable cutting member;

a drive apparatus connected to the manufacturing and cutting apparatuses and having a common drive shaft with the manufacturing and cutting apparatuses; and means for accelerating a cutting movement and coupled to the common drive shaft, wherein the lever arrangement is provided with means for setting a degree of acceleration.

18. An apparatus for manufacturing a cushioning packaging material from a web-shaped material having at least two layers, the apparatus comprising a material supply shaft for deforming side edges of the web-shaped material into a substantially rolled shape with bead-shaped margins; and a device for receiving a deformed material and for joining layers of the deformed material along a substantially central region thereof in a direction of a longitudinal extent thereof, the device having at least one first wheel-shaped member and at least one second wheel-shaped member both having embossing sections provided at a periphery of respective wheel-shaped members and engaging each other for joining oppositely located edge regions of the supplied web-shaped material by embossing when rolled regions of the supplied web-shaped material pass between the embossing sections of the respective wheel-shaped members, wherein axes of rotation of the first and second wheel-shaped members lie in a plane that is inclined to a running plane of the deformed material, which is determined by a longitudinal extent of the supply shaft, at an angle deviating from a right angle.

19. An apparatus according to claim 18, wherein the first wheel-shaped member is formed as a chain wheel, and the second wheel-shaped member has a plurality of tooth-shaped embossing sections on the periphery thereof, with the tooth-shaped embossing sections each having tooth flanks thereof converging to a tooth root and each having a rounded apex section.

* * * * *